United States Patent [19]

Smith

[11] 4,324,968

[45] Apr. 13, 1982

[54] MICROWAVE OVEN CAVITY EXCITATION SYSTEM PROVIDING CONTROLLED ELECTRIC FIELD SHAPE FOR UNIFORMITY OF ENERGY DISTRIBUTION

[75] Inventor: Peter H. Smith, Anchorage, Ky.

[73] Assignee: General Electric Company, Louisville, Ky.

[21] Appl. No.: 203,091

[22] Filed: Nov. 3, 1980

[51] Int. Cl.[3] ..... H05B 6/74

[52] U.S. Cl. ..... 219/10.55 F; 219/10.55 B

[58] Field of Search ..... 219/10.55 F, 10.55 M, 219/10.55 B, 10.55 R, 10.55 A, 10.55 D

[56] References Cited

U.S. PATENT DOCUMENTS

| | | | |
|---|---|---|---|
| 3,210,511 | 10/1965 | Smith | 219/10.55 F |
| 3,439,143 | 4/1969 | Cougoule | 219/10.55 |
| 3,493,709 | 2/1970 | Lavoo et al. | 219/10.55 |
| 3,819,900 | 6/1974 | Ironfield | 219/10.55 F |
| 4,079,221 | 3/1978 | McGillem et al. | 219/10.55 F |
| 4,107,501 | 8/1978 | Ironfield | 219/10.55 F X |
| 4,144,436 | 3/1979 | Hauck | 219/10.55 F |
| 4,160,144 | 7/1979 | Kashyap et al. | 219/10.55 A |

OTHER PUBLICATIONS

Alan J. Simmons "Circularly Polarized Slot Radiators," *IRE Transactions on Antennas and Propagation,* vol. AP-5, No. 1, pp. 31-36, Jan., 1957.

"A Discussion of Ferrite Material Characteristics in Waveguide Digital Phase Shifters," Trans-Tech, Inc., 12 Meeme Avenue, Gaithersburg, Md., Tech-Briefs No. 652, *Microwaves,* vol. 4, No. 2, Feb. 1965, p. 45.

Miller, U.S. Patent Application Serial No. 178,324, filed Aug. 15, 1978.

*Primary Examiner*—Arthur T. Grimley

*Attorney, Agent, or Firm*—H. Neil Houser; Radford M. Reams

[57] ABSTRACT

A microwave oven cavity excitation system for promoting time-averaged uniformity of microwave energy distribution within the cooking cavity. Circularly-polarized microwave energy is radiated from a feed waveguide into an adjacent cooking cavity by means of an aperture, such as an X-slot, in the feed waveguide properly electrically located laterally within the feed waveguide so as to nominally radiate an electric field having circular polarization properties and, overall, shaped as an approximate hemisphere. A cross-sectional slice of the field, for example in the plane of the food supported on a conventionally-located shelf, is circular in shape. The radiating X-slot is controllably and selectively electrically moved laterally with respect to the waveguide centerline with the result that the sectional shape of the resulting field changes from circular to elliptical, with the degree and orientation of the ellipse depending upon the direction and degree of movement of the coupling aperture with respect to the waveguide centerline. The shape of the field is constantly varied through various elliptical configurations during operation, to provide the desired time-averaged uniformity of energy distribution through a suitably-programmed controller.

7 Claims, 19 Drawing Figures

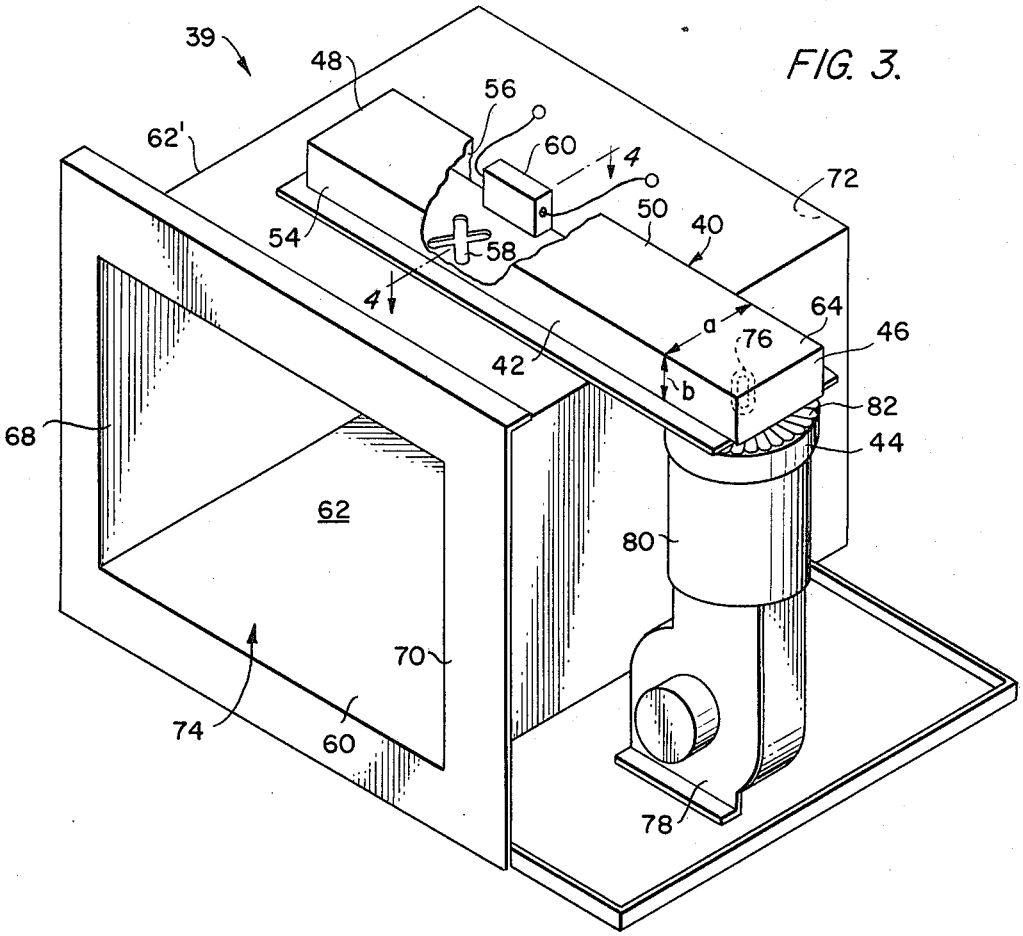
FIG. 3.
FIG. 4.
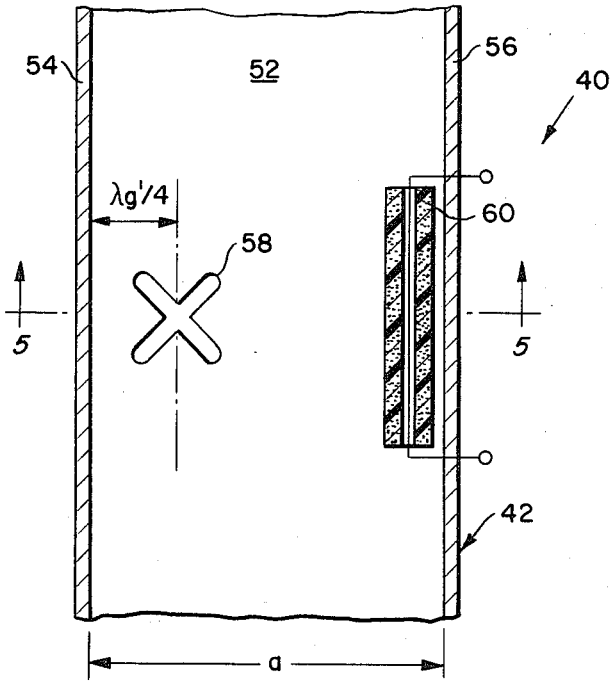
FIG. 5.
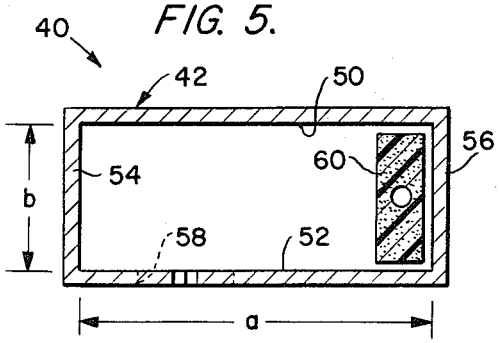

MICROWAVE OVEN CAVITY EXCITATION SYSTEM PROVIDING CONTROLLED ELECTRIC FIELD SHAPE FOR UNIFORMITY OF ENERGY DISTRIBUTION

BACKGROUND OF THE INVENTION

The present invention relates generally to microwave oven capacity excitation systems and, more particularly, to microwave oven cavity excitation systems for promoting time-averaged uniformity of microwave energy distribution within the cooking cavity.

In a microwave oven cooking cavity, the spatial distribution of the microwave energy tends to be non-uniform. As a result, "hot spots" and "cold spots" are produced at different locations. For many types of foods, cooking results are unsatisfactory under such conditions because some portions of the food may be completely cooked while others are barely warmed. The problem becomes more severe with foods of low thermal conductivity which do not readily conduct heat from the areas which are heated by the microwave energy to those areas which are not. An example of a food falling within this class is cake. However, other foods frequently cooked in microwave ovens, such as meat, also produce unsatisfactory cooking results if the distribution of microwave energy within the oven cavity is not uniform.

A conventionally accepted explanation for the non-uniform cooking pattern is that electromagnetic standing wave patterns, known as "modes," are set up within the cooking cavity. When a standing wave pattern is set up, the intensities of the electric and magnetic fields vary greatly with position. The precise configuration of the standing wave or mode pattern is dependent at least upon the frequency of microwave energy used to excite the cavity and upon the dimensions of the cavity itself. (While it is possible to theoretically predict the particular mode patterns which may be present in the cavity, it should be noted that actual experimental results are not always consistent with theory).

In an effort to alleviate the problem of non-uniform energy distribution, a great many approaches have been tried. The most common approach is the use of a device known as a "mode stirrer," which typically resembles a fan having metal blades. The mode stirrer rotates and may be placed either within the cooking cavity itself (usually protected by a cover constructed of a material transparent to microwaves) or, to conserve space within the cooking cavity, may be mounted within a recess formed in one of the cooking cavity walls, normally the top.

The function of the mode stirrer is to continually alter the mode pattern within the cooking cavity. If a particular mode exists for only a moment, and then is immediately replaced by a mode having different hot and cold spots, then, averaged over a period of time, the energy distribution within the cavity is more uniform. In addition to varying reflection properties, a mode stirrer also tends to "pull" the oscillation frequency of the magnetron (which is a self-oscillating device) about the 2450 MHz center frequency. The cyclical variation in precise operation frequency causes different modes to be theoretically possible in the oven cooking cavity, depending also upon the precise cavity dimensions.

Another approach to the problem of non-uniform energy distribution is disclosed in commonly-assigned U.S. patent application Ser. No. 178,324, filed Aug. 15, 1980, by Matthew S. Miller, and entitled "MICROWAVE OVEN CAVITY EXCITATION SYSTEM EMPLOYING CIRCULARLY POLARIZED BEAM STEERING FOR UNIFORMITY OF ENERGY DISTRIBUTION AND IMPROVED IMPEDANCE MATCHING". The disclosed Miller microwave oven cavity excitation system introduces circularly-polarized electromagnetic wave energy into a cooking cavity through a pair of feed points appropriately phased to provide a concentrated beam. The relative phasing of the feed points is varied as a function of time to steer the concentrated beam to sweep the interior of the cavity, thereby improving the time-averaged energy distribution within the cooking cavity. Further, the disclosure of the Miller application points out that, as a result of the circular polarization, standing waves in the direction of one of the cavity dimensions are minimized, and the amount of energy reflected back to the generator is reduced. The Miller application also shows how various forms of coupling apertures or slots in a rectangular waveguide can be located with respect to the waveguide so as to radiate a circularly-polarized electromagnetic field.

From the foregoing brief summary of two approaches to achieving time-averaged uniformity of energy distribution, it will be appreciated that this is a formidable consideration in the development of practical microwave ovens.

The present invention provides a micowave energy excitation system which advantageously promotes time-averaged uniformity of microwave energy distribution within the cooking cavity.

SUMMARY OF THE INVENTION

Accordingly, it is an object of the invention to provide a microwave oven excitation system which promotes time-averaged uniform energy distribution within a microwave oven cooking cavity.

It is another object of the invention to promote time-averaged uniformity of energy distribution by controlling electric field shape in the plane of the food.

It is still another object of the invention to provide a system for controlling electric field shape and for varying the field shape without the use of moving parts.

In connection with the foregoing object, it is an object of the invention to provide such a system which may be programmed to provide predetermined electric field shapes and periodic changing of the electric field shape by means of relatively simple and therefor low-cost electronic controls.

Briefly stated, and in accordance with an overall concept of the invention, circularly-polarized microwave energy is radiated from a feed waveguide into an adjacent cooking cavity by means of an aperture, such as an X-slot, in the feed waveguide electrically located laterally within the feed waveguide so as to radiate circularly-polarized microwave energy into the cooking cavity. As is known in the microwave art in general, properly-located waveguide apertures result in the radiation of circularly-polarized energy and, as pointed out in the above-referenced Miller application Ser. No. 178,324, this technique may advantageously be employed in a microwave oven.

Such an X-slot properly located and coupled to a microwave oven cooking cavity radiates an electric field having circular polarization properties and, overall, shaped as an approximate hemisphere. A cross-sectional slice of the field, for example in the plane of the food supported on a conventionally-located shelf, is circular in shape.

In accordance with an overall concept of the invention, the radiating X-slot is controllably and selectively moved with respect to the waveguide centerline with the result that the sectional shape of the resulting field changes from circular to elliptical, with the degree and orientation of the ellipse depending upon the direction and degree of movement of the coupling aperture with respect to the waveguide centerline.

Rather than provide physically-moving parts, a device is provided for varying merely the electrical position of the coupling aperture with respect to the feed waveguide center line as a function of time. Preferably, this device comprises a body of material having variable states of permeability positioned in the feed waveguide between the coupling aperture and one of the side walls. Suitable materials are ferrite or garnet slabs such as are commonly-employed in digital phase shifters.

The behavior of such materials, such as ferrites, in electromagnetic circuits is well known. One important property is that the dielectric constant may be controlled by changing its magnetic properties, in particular, its permeability. If the ferrite has magnetic remanence, a controlled pulse of current can be employed to establish a particular working point on the B-H curve of the ferrite to produce a corresponding change in the dielectric constant. Since the ferrite material has a "memory", a controlled current pulse can effectively establish the relative electrical position of the X-slot. The ratio and plane of the ellipsoid can be controlled by a simple current generator, programmed to provide the required shape and variation for a particular food.

The shape of the field is constantly varied through various elliptical configurations during operation, to provide the desired time-averaged uniformity of energy distribution through a suitably-programmed controller.

It is additionally contemplated that the various electromagnetic boundary conditions imposed by various microwave oven cavities, as well as various food loads, may be compensated for by the programmed controller.

Briefly stated, and in accordance with a more particular aspect of the invention, an excitation system for a microwave oven cooking cavity having electrically conductive walls comprises a rectangular feed waveguide having a center line and extending along the outer surface of one of the cooking cavity walls, one wall of the waveguide being common with at least a portion of the one wall of the cooking cavity. A microwave energy generator, such as a magnetron, is coupled to the feed waveguide to establish a mode therein. A coupling aperture, such as an X-slot, is provided in the common wall for feeding and radiating microwave energy into the cooking cavity. The coupling aperture is electrically located with respect to the center line of the feed waveguide so as to nominally radiate circularly polarized microwave energy into the cooking cavity, with an electric field distribution of generally circular cross-section. Further, a device is provided for varying the electrical position of the coupling aperture with respect to the feed waveguide center line as a function of time, whereby the cross-sectional distribution of the electric field radiated into the cooking cavity is periodically changed to an ellipsoid.

BRIEF DESCRIPTION OF THE DRAWINGS

While the novel features of the invention are set forth with particularity in the appended claims, the invention, both as to organization and content, will be better understood and appreciated along with other objects and features thereof, from the following detailed description taken in conjunction with the drwings, in which:

FIG. 3 is a highly schematic isometric view of a microwave oven cooking cavity with a feed waveguide, such as that which is illustrated in FIG. 2, coupled thereto and supplied by a microwave energy source;

FIG. 4 is an enlarged vertical section taken along line 4—4 of FIG. 3;

FIG. 5 is a section taken along line 5—5 of FIG. 4;

DETAILED DESCRIPTION OF THE PREFERRED EMBODIMENTS

Figure 1:
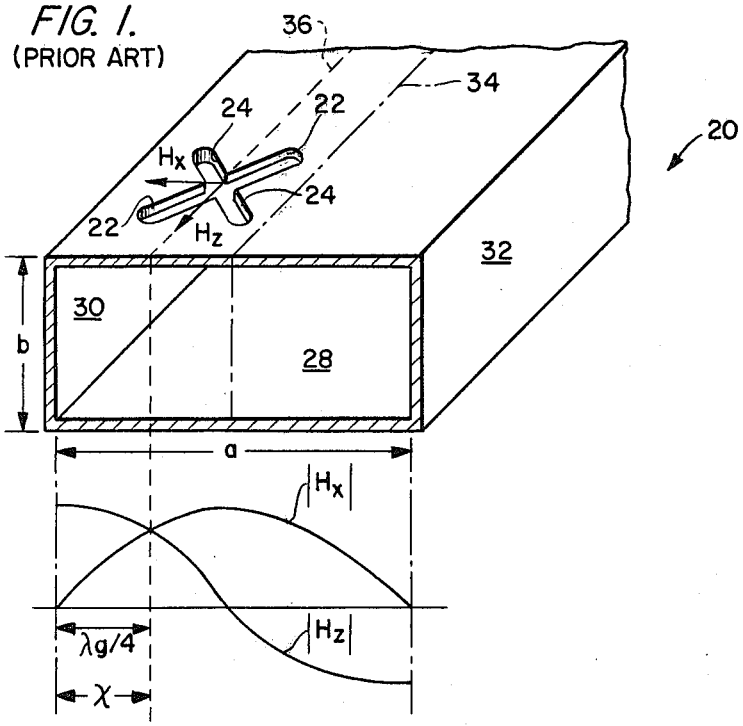
FIG. 1. (PRIOR ART)
FIG. 1 is an isometric view of a rectangular waveguide section having a pair of crossed slots cut into one of the broad walls at the proper location to cause circularly-polarized microwave energy to be radiated in accordance with a prior art technique.

Referring first to FIG. 1, there is shown a rectangular waveguide 20 having a pair of narrow slots 22 and 24 crossed at right angles and located at the proper point in a broad wall of the waveguide 20 so as to radiate a circularly polarized wave in accordance with a prior art technique, together with a curve depicting transverse and longitudinal magnetic field intensity $|H_x|$ and $|H_z|$ across the waveguide 20 for the $TE_{01}$ mode.

The waveguide 20 is of conventional rectangular configuration for supporting a $TE_{01}$ mode, with the width or major dimension along the broad walls, i.e. top wall 26 and bottom wall 28, designated "a", and the minor dimension along the narrower walls, i.e., the side walls 30 and 32, designated "b". In FIG. 1, it may be seen that the crossed slots 22 and 24 are asymetrically located with respect to the center line 34 of the waveguide 20.

The specific manner in which X-slots such as the slots 72 and 74 radiate circularly polarized electromagnetic radiation is described in detail in an article by Alan J. Simmons, "Circularly Polarized Slot Radiators", *IRE Trans. Antennas and Propagations,* Vol. AP-5, No. 1, pp 31–36, January, 1957, the entire disclosure of which is hereby expressly incorporated by reference.

This Simmons article explains the reasons why such appropriately located slots in a $TE_{01}$ mode rectangular waveguide radiate circular polarization in the following manner, which may be read in conjunction with FIG. 1 herein:

The equations for the transverse and longitudinal magnetic fields of the dominant ($TE_{01}$) mode in a rectangular waveguide are:

$$H_x = H_o\sqrt{1-\left(\frac{\lambda}{2a}\right)^2}\ \sin\frac{\pi x}{a}\text{, and}$$

$$H_z = -jH_o\left(\frac{\lambda}{2a}\right)\cos\frac{\pi x}{a},$$

where $H_x$ is the transverse magnetic-field intensity,
$H_z$ is the longitudinal magnetic-field intensity,
$H_o$ is a constant,
$\lambda$ is the free-space wavelength,
a is the waveguide width, and
x is the transverse coordinate.

Two values of x can be found for which $|H_x| = |H_z|$.

These values or points are given by $$x = \frac{a}{\pi}\,\mathrm{ctn}^{-1}\left[\pm\sqrt{\left(\frac{2a}{\lambda}\right)^2 - 1}\right]$$

At points on the interior broad face of the waveguide for which the equation immediately above holds, the magnetic-field vector, $\vec{H}$, is circularly polarized since the x and z components of this vector are equal in magnitude and in phase quadrature. From the boundary condition, $\vec{J}=\vec{n}\times\vec{H}$, it follows that the vector-current distribution, $\vec{J}$, is likewise circularly polarized at these same points. A small circular hole cut through the wall at such a point accordingly is excited by the circularly polarized current and radiates a circularly polarized wave, right-hand circular from one side of the waveguide and left-hand from the other.

Simmons goes on to point out that, to couple a large amount of power, instead of a circular hole, a pair of narrow radiating slots at right angles to each other may be cut in the waveguide wall, the center of the pair being at the circularly polarized spot. The pair then radiates circular or near-circular polarization. The orientation of the crossed-slot pair is arbitrary, but for convenience they may be at ±45°.

In FIG. 1, for convenience of illustration, the center 36 of the crossed slots 22 and 24 is chosen to be halfway between the side wall 30 and the waveguide centerline 34, for a value of $x=a/4$ or $x=\lambda_g/4$ (one-fourth of a guide wavelength). This particular position results in circular polarization where $\lambda/2a=1/\sqrt{2}$. $\lambda$ at 2450 MHz is 12.24 cm in free space. Then $a=\lambda\sqrt{2}/2=8.65$ cm.

If the two electric field components (not shown) of the field radiated by the FIG. 1 crossed slots 22 and 24 are equal (i.e., $\sin E_x=\cos E_y$, where $E_x$ and $E_y$ are the magnitudes of the two electric field components, having a phase displacement of 90°), the cross-sectional shape of the field is circular.

However if these magnitudes are differentially changed, the shape of resulting field changes from circular to elliptical, the degree of ellipsoid being the ratio of the magnitude difference. For example, with a slot spacing of $\lambda_g/4$ or 45°, $\sin 45° = \cos 45°$, for a sine/cosine ratio of 1:1 which produces a circular shape. By moving the slot center line 10 electrical degrees, i.e., to 35°, the ratio changes to $\sin 35°/\cos 35°$ or 0.70:1, producing a elliptical shape. Thus the value of the electric field can be changed in both planes, but still exhibiting circular polarization.

Figure 2:
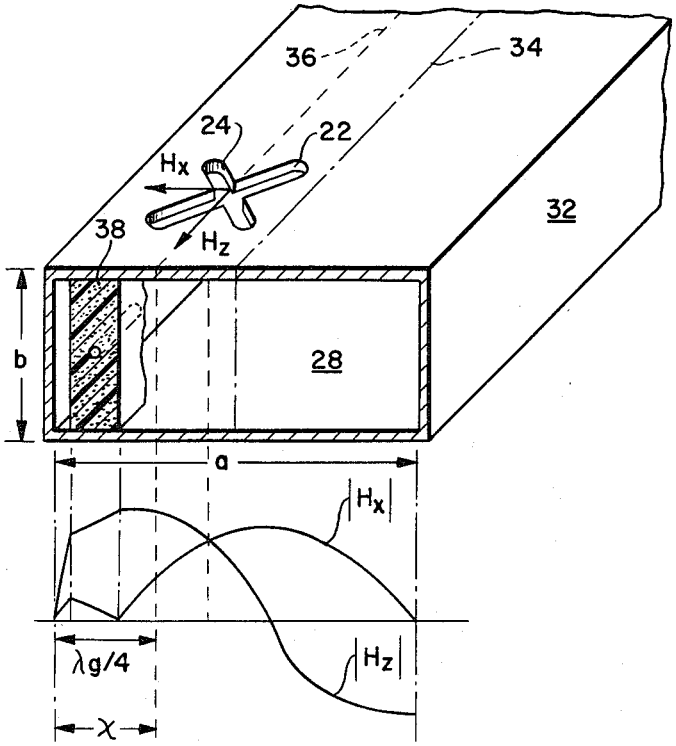
FIG. 2 illustrates an overall concept of the invention, and is a waveguide section similar to that of FIG. 1, but further including a device for varying electrical position of the X-slot with respect to the waveguide centerline.

It would be incovenient to physically move the radiating slots 22 and 24 with respect to the waveguide 20 centerline 34 since moving parts would create a reliability problem such as wear and arcing, require extensive mechanisms to provide differential and controlled motion, all adding to system cost. FIG. 2 illustrates a static method of providing the equivalent of the X-slot displacement in accordance with the invention.

In FIG. 2, the waveguide 20 is loaded with a low-loss ferrite or garnet slab 38 having the correct dimensions and composition to effect a variatio of guide wavelenth with changing bias current. The behavior of ferrites and similar materials in electromagnetic circuits is well known, in that the dielectric constant may be controlled by changing the magnetic properties. If the ferrite has magnetic remanence, a controlled pulse of current will establish a conditioned working point on the B-H curve of the ferrite to produce a corresponding change in value of dielectric constant. Thus the magnitude of current establishes the relative electric position of the X-slots 22 and 24. The ratio and plane of ellipsoid can be controlled by a simple current generator, programmed to provide the required shape and field varition for a particular food.

Referring now to FIG. 3, there is shown the general structure of a microwave oven generally designated 39 and including an excitation system 40 operating in accordance with the principles explained above with reference to FIG. 2. The excitation system 40 more particularly comprises a feed waveguide 42, with a microwave energy generator, preferably a magnetron tube 44, for producing cooking microwaves at any suitable frequency, such as 2450 MHz, coupled at one end 46. The far end 48 of the feed waveguide is terminated in a short circuit.

The feed waveguide 42 is rectangular and dimensioned so as to support and propogate a $TE_{01}$ mode. Specifically, the width "a" along the major dimension as defined by top wall 50 and bottom wall 52 is selected to be slightly more than one-half wavelength, and the height "b" along the minor dimension as defined by side walls 54 and 56 is selected to be less than one-half wavelength, preferably approximately 50% of the "a" dimension. In accordance with the invention, the feed waveguide 42 has an X-slot coupling aperture 58 and a device for varying the electrical position of the X-slot aperture 58 with respect to the feed waveguide 42 centerline, this device being a ferrite body 60. The X-slot aperture 58 and the body 60 are both positioned as described above with reference to FIG. 1 (aperture 58 only) and with reference to FIG. 2. The aperture 58 radiates circularly-polarized microwave energy into a cooking cavity 62 positioned therebelow.

In FIG. 3, the feed waveguide 42 extends along the outer surface 64' of the cavity 62 top wall 64, the bottom waveguide wall 52 sharing a common portion therewith. The microwave oven 39, in addition to the excitation system 40, includes the aforementioned cooking cavity 62 bounded by conductive walls, with the top wall 64 and opposed bottom wall 66, left and right opposed side walls 68 and 70, and a rear wall 72. An access opening 74 is provided, and will be understood to be covered by a conventional access door (not shown) comprising a conductive wall for the cooking cavity 62 and opposed to the rear wall 72.

The magnetron tube 44 is air cooled and delivers its 2450 Mhz microwave energy output at an antenna or probe 76. In connection with the magnetron 44, there are a blower 78 and a cylindrical rubber duct 80 for channeling the air flow over magnetron cooling fins 82. As is conventional in microwave oven practice, the feed waveguide 42 serves the dual functions of conveying microwaves, as well as air flow. Specifically, a portion of the cooling air flow passing from the blower 78 over the magnetron 44 cooling fins 82 passes further through suitable microwave-impermeable apertures into the waveguide 42, through the waveguide 42, and then into the cooking cavity 62 through either the X-slot aperture 48 or other small microwave-impermeable apertures (not shown). Such air flow into the cooking cavity 62 aids in carrying away moisture-laden air, which escapes through additional conventional microwave-impermeable vent apertures (not shown), and also provides some utilization of magnetron waste heat.

It will be understood that numerous other components, not illustrated, are required in a complete microwave oven, but for clarity of illustration and description, only those elements believed essential for a proper understanding of the present invention are shown and described. These other components required include oven control and door interlock circuitry, as well as high voltage DC power supply for the magnetron 44. These elements may all be conventional, and as such are well known to those skilled in the art.

Referring now, in addition to FIG. 3, to FIGS. 4 and 5, additional details of the feed waveguide 42 portion of the excitation system 40 are shown. In particular, the orientation of the X-slot aperture 58 and the ferrite body 60 within the feed waveguide 42 are shown. Comparing FIGS. 4 and 5, on the one hand, with FIG. 2, on the other hand, it may be seen that the positions of the respective ferrite bodies 60 and 38 are on the opposite side wall of the waveguide 42 with respect to the aperture 58. However, it will be appreciated that this is a mere matter of choice, and that the same results can be obtained.

Figure 6:
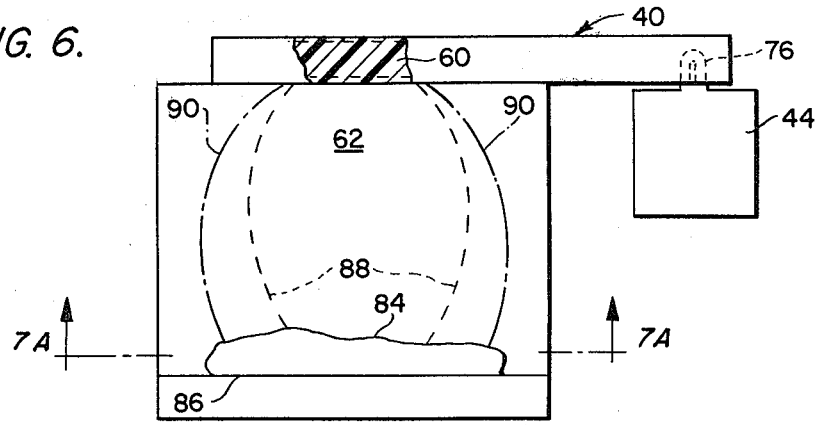
FIG. 6 is a front elevation comparable to FIG. 3 illustrating in highly-schematic form the manner in which the electric field shape is varied in accordance with the invention.

The operation of the invention may be better understood with reference to FIG. 6 which is a highly simplified front elevational view comparable to that of FIG. 3, and further including a representative food load 84 supported on a horizontal dielectric shelf 86. FIG. 6 is a representation of two field shapes 88 and 90 which may be radiated into the cavity 60. More particularly, depicts a cross-section of a circular field in the plane of the food load 84, viewed in a directio toward the X-slot coupling aperture 58. FIGS. 8A and 9A may be compared with FIG. 7A, and illustrate distortion of the field pattern into elliptical shapes, elongation being along an x axis in FIG. A, and along a y axis in FIG. 9A.

Figure 7A:
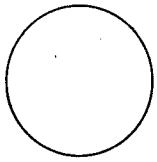
FIG. 7A is a section taken along line 7A—7A of FIG. 6 illustrating in highly-schematic form the circular cross section of the electric field distribution at the plane of the food in the FIGS. 5 and 6 microwave oven.
Figure 7B:
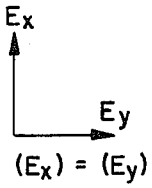
FIG. 7B is a vector diagram depicting the relative strengths of the X and Y electric field components in the field represented in FIG. 7A.
Figure 8A:
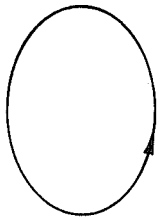
FIGS. 8A and 9A are views comparable to FIG. 7A showing possible variations in the electric field shape.
Figure 8B:
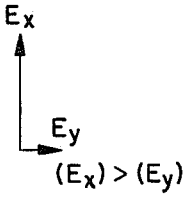
FIGS. 8B and 9B are respective vector diagrams showing the X and Y components of the electric field in the FIG. 8A and 9A representations.
Figure 9A:
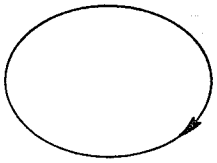
Figure 9B:
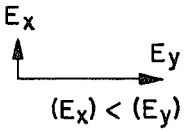

FIGS. 7B, 8B and 9B correspond respectively to FIGS. 7A, 8A and 9A, and are vector diagrams representing the magnitude of the electric field components of the microwave energy field in the plane of the cooking cavity. In FIG. 7B, the x and y components are equal, while in FIGS. 8B and 9B they are unequal to produce the elliptical field shapes.

These different patterns are produced by varying the permeability and thus the effective dielectric constant of the body 50 of ferrite or garnet material. These different points are represented on the hysteresis curves of FIGS. 7C, 8C and 9C, which similarly respectively correspond to FIGS. 7A, 8A and 9A.

Figure 7C:
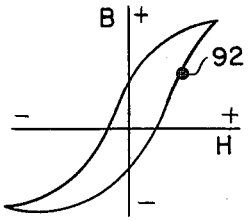
FIG. 7C illustrates a point on a exemplary B-H hysteresis curve depicting the state of magnetization of the ferrite body in the feed waveguide to produce the field configuration represented by FIGS. 7A and 7B.

In particular, the point 92 on hysteresis curve of FIG. 7C is a programmed nominal center working point, predetermined, taking into account the precise magnetic characteristics of the material, as well a the waveguide dimensions, to effectively electrically position the coupling aperture 58 with respect to the waveguide 40 lateral dimension so as to produce a circular cross section in the electromagnetic field.

Figure 8C:
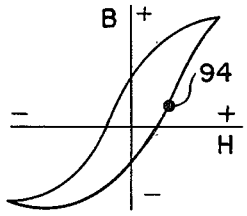
FIGS. 8C and 9C are representative B-H curves comparable to that of FIG. 7C, and corresponding to the field distributions depicted in FIGS. 8A and 9A, respectively.
Figure 9C:
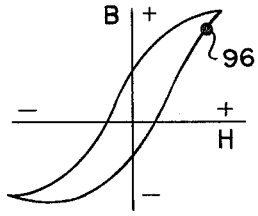

In contrast, the points 94 of FIG. 8C and 96 of FIG. 9C effectively establish working points on the hysteresis curve at which the elliptical distributions illustrated result.

Figure 10A:
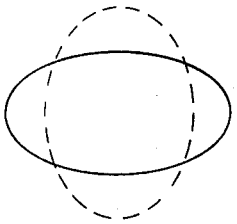
FIG. 10A is a depiction of still another field distribution showing how the shape of the electric field distribution may be dynamically changed between a plurality of configurations.
Figure 10B:
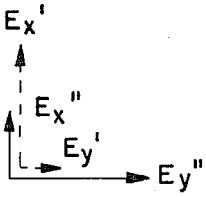
FIG. 10B illustrates a pair of vector diagrams corresponding to the field shapes depicted in FIG. 10A.
Figure 10C:
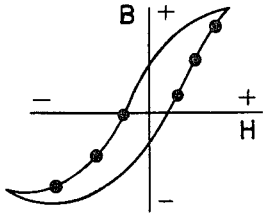
FIG. 10C illustrates corresponding points on a B-H hysteresis curve.

As depicted in FIGS. 10A, 10B and 10C, these various points may be dynamically varied as a function of time to introduce time-averaged randomness into the microwave energy distribution within the cavity 62.

Figure 11:
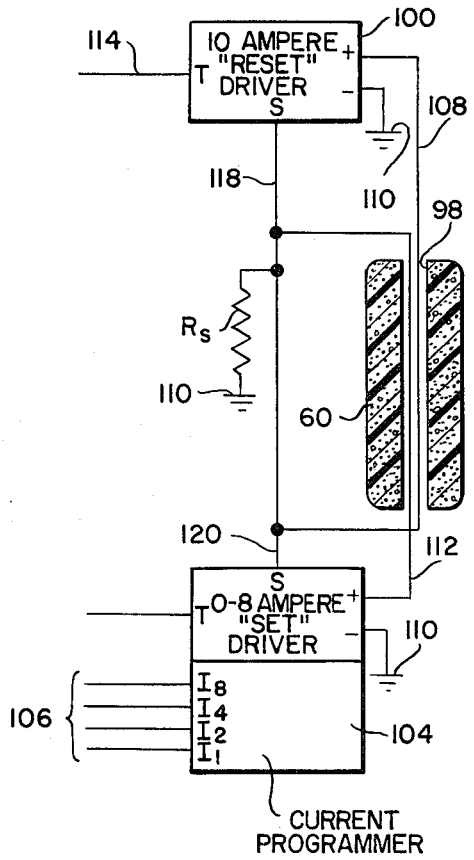
FIG. 11 illustrates in block diagram form one form of electrical circuit which may be employed to control the magnetization of the ferrite slab.

With reference now to FIG. 11, the manner in which the ferrite or garnet body 38 (FIG. 2) or 60 (FIGS. 3, 4, 5 and 6) is controlled to provide different states of permeability will now be explained. As is known, materials such as ferrite or garnet can provide low field loss properties, while remembering a past history of magnetization, as represented by the hysteresis loops of FIGS. 7C, 8C, 9C and 10C. This property may also be expressed as magnetic remanence. The ferrite or garnet bodies are configured roughly as a tube with a axial bore 98 for conductors which provide control magnetic fields. Thus the ferrite or garnet body acts as a thick toroid. If a positive pulse of current is sent through the wire, creating sufficient field to latch the ferrite body 60, it remains magnetized in a plus direction. If, a negative pulse is sent through the wire, the body 60 is magnetized in the opposite direction.

In digital phase shifter applications, such ferrite bodies are operated in saturation, at either one direction or the other. Thus, to obtain a range of intermediate values, a plurality of individual ferrite bodies of different sizes are required, and these are selectively magnetized in a binary sequence. An example is described in "A Discussion of Ferrite Material Characteristics in Waveguide Digital Phase Shifters," Trans-Tech, Inc., Tech- Briefs No. 652, *Microwaves,* Vol. 4, No. 2, Feb. 1965, p. 45.

The ferrite of garnet body 60 of the present invention is, however, operated at intermediate magnetization values, thus providing a range of control.

Referring now to FIG. 11 in detail, a pair of current drivers 100 and 102 are provided, the current driver 100 being denoted a "reset" driver, and designed so as to provide a current pulse of sufficient magnitude to completely saturate the ferrite body 60 in one direction. The other driver 102, termed a "set" driver is selectively controllable so as to provide current pulses of particular desired magnitudes. To accomplish this a current programmer 104 receiving a binary coded control input on lines 106 is connected to the set current driver 102. A (+) output line 108 of the "reset" current driver 102 passes through the bore 98 and then through a current sensing resistor $R_s$ to a circuit reference point 110. The (+) output line 112 of the "set" current driver 102 passes through the bore 98 in the opposite direction, and then to the circuit reference point 110 through the current sensing resistor $R_s$. The "reset" driver 100 and the "set" driver 102 are triggered by respective input lines 114 and 116 connected to trigger "T" inputs.

The drivers 100 and 102 may be any suitable constant current source. Due to the magnetic "memory" properties of the ferrite or garnet body 60, only a pulse of current is required to establish a desired permeability value, with the maximum pulse amplitude determining the degree of magnetization. Any one of a variety of conventional control approaches may be employed to provide these constant current sources. For example, voltage drop across the current sensing resistor $R_s$ may be sensed by means of the lines 118 and 120 connected to the sense "S" inputs, and internally compared against a reference to determine when the current through the magnetizing wire 108 or 112 has reached a desired value. Because the ferrite or garnet body 60 is configured as a torroid, it behaves as an inductor in that when a voltage is applied, current flow begins at zero and then logarithmically rises.

This logarithmic current rise characteristic may be employed in a simple control scheme without the use of feedback simply through the use of pulses of programmed width, particular widths being predetermined so as to result in particular peak current.

It is contemplated that the circuitry of FIG. 11 be controlled through suitable connections to a microprocessor controller (not shown) included within the microwave oven 38. Thus the trigger lines 114 and 116, as well as the current control input lines 106, may be connected to output lines of the microprocessor controller (not shown).

In operation, the circuit of FIG. 11 is repeatedly operated to establish varying degrees of magnetization in the ferrite or garnet body 60, and thus varying field shapes as illustrated in FIGS. 7A, 8A, 9A and 10A. In the particular arrangement illustrated in FIG. 11, sixteen discrete permeability values are possible, as indicated by the four binary control input lines 106. For each cycle of operation, a trigger signal along the input line 114 causes the reset driver 100 to pulse the core 60, thereby magnetizing it completely in one direction and providing a reproducable reference. A binary current value is loaded into the current programmer 104 through the input lines 106. Then, a control pulse on the trigger input line 116 causes the set current driver 102 to provide a controlled pulse, for example in the range of 0 to 10 amperes, through the core 60 in the opposite direction, magnetizing the ferrite or garnet body at some predetermined point on the historesis curve.

In view of the foregoing, it will be appreciated that the present invention provides a means for controlling electric field shape and for varying the field so as to provide more uniform heating within a microwave oven cooking cavity.

While a specific embodiment of the invention has been illustrated and described herein, it is realized that numerous modifications and changes will occur to thos skilled in the art. It is, therefore, to be understood that the appended claims are intended to cover all such modifications and changes as fall within the true spirit and scope of the invention.

What is claimed is:

1. An excitation system for a microwave oven cooking cavity having electrically conductive walls, said excitation system promoting time-averaged uniformity of energy distribution and comprising:

a rectangular feed waveguide extending along the outer surface of one of the cooking cavity walls, one wall of said waveguide being common with at least a portion of said one wall of the cooking cavity;

a microwave energy generator coupled to said feed waveguide to establish a mode therein;

a coupling aperture in said common wall for feeding microwave energy into the cooking cavity, said coupling aperture electrically located laterally within said feed waveguide so as to radiate microwave energy polarized in a first sense into the cooking cavity; and a device for varying the electrical position of said coupling aperture with respect to said feed waveguide centerline as a function of time, whereby the microwave energy radiated into the cooking cavity is periodically changed to a second polarization sense.

2. An excitation system according to claim 1, wherein:

said feed waveguide has a pair of side walls, a top wall, and a bottom wall, said common wall being one of said top or bottom walls; and wherein said device for varying electrical position comprises a body of material having controllable states of permeability positioned in said feed waveguide between said coupling aperture and one of said side walls.

3. An excitation system according to claim 2, wherein said body of material having controllable states of permeability comprises a ferrite or garnet slab.

4. An excitation system for a microwave oven cooking cavity having electrically conductive walls, said excitation system promoting time-averaged uniformity of energy distribution and comprising:

a rectangular feed waveguide extending along the outer surface of one of the cooking cavity walls, one wall of said waveguide being common with at least a portion of said one wall of the cooking cavity;

a microwave energy generator coupled to said feed waveguide to establish a mode therein;

a coupling aperture in said common wall for feeding microwave energy into the cooking cavity, said coupling aperture electrically located laterally within said feed waveguide so as to radiate circularly-polarized microwave energy into the cooking cavity with an Electric field distribution of generally circular cross-section; and a device for varying the electrical position of said coupling aperture with respect to said feed waveguide centerline as a function of time, whereby the cross-sectional distribution of the Electric field radiated into the cooking cavity is periodically changed to an ellipsoid.

5. An excitation system according to claim 4, wherein:

said feed waveguide has a pair of side walls, a top wall, and a bottom wall, said common wall being one of said top or bottom walls; and wherein said device for varying electrical position comprises a body of material having controllable states of permeability positioned in said feed waveguide between said coupling aperture and one of said side walls.

6. An excitation system according to claim 5, wherein said body of material having controllable states of permeability comprises a ferrite or garnet slab.

7. A method for exciting a microwave oven cooking cavity and promoting time-averaged uniformity of electromagnetic energy distribution within the cavity, said method comprising:

generating microwave energy;

coupling the generated microwave to a rectangular feed waveguide extending along the outer surface of one of the cooking cavity walls, one wall of said waveguide being common with at least a portion of the one wall of the cooking cavity;

radiating microwave energy from the feed waveguide into the cooking cavity through a coupling aperture in the common wall, the coupling aperture being electricallylocated laterally within the feed waveguide so as to radiate circularly-polarized microwave energy into the cooking cavity with an Electric field distribution of generally circular cross-section; and varying the electrical position of the coupling aperture with respect to the feed waveguide centerline as a function of time, whereby the cross-sectional distribution of the Electric field radiated into the cooking cavity is periodically changed to an ellipsoid.

* * * * *